US006505607B1

(12) United States Patent
Mattes

(10) Patent No.: US 6,505,607 B1
(45) Date of Patent: Jan. 14, 2003

(54) COMMON RAIL

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/856,612

(22) PCT Filed: Aug. 19, 2000

(86) PCT No.: PCT/DE00/02840

§ 371 (c)(1),
(2), (4) Date: Aug. 20, 2001

(87) PCT Pub. No.: WO01/23750

PCT Pub. Date: Apr. 5, 2001

(30) Foreign Application Priority Data

Sep. 24, 1999 (DE) ..... 199 45 786

(51) Int. Cl.[7] ..... F02M 55/00; F02M 41/00

(52) U.S. Cl. ..... 123/456; 123/469

(58) Field of Search ..... 123/456, 468, 123/469

(56) References Cited

U.S. PATENT DOCUMENTS

| | | | | |
|---|---|---|---|---|
| 5,291,869 A | * | 3/1994 | Bennett | 123/41.31 |
| 6,213,095 B1 | * | 4/2001 | Asada et al. | 123/456 |
| 6,374,806 B1 | * | 4/2002 | Keeley et al. | 123/456 |
| 6,390,131 B1 | * | 5/2002 | Kilgore | 123/456 |
| 6,408,826 B2 | * | 6/2002 | Asada et al. | 123/456 |
| 6,415,768 B1 | * | 7/2002 | Usui | 123/468 |
| 2002/0108660 A1 | * | 8/2002 | Braun et al. | 123/456 |

* cited by examiner

*Primary Examiner*—Tony M. Argenbright
*Assistant Examiner*—Hai Huynh
(74) *Attorney, Agent, or Firm*—Ronald E. Greigg

(57) ABSTRACT

The invention relates to a common rail for a common rail fuel injection system of an internal combustion engine, having a base body whose interior communicates with a plurality of connections. To increase the high-pressure strength, the interior is formed by at least two substantially circular-cylindrical recesses whose longitudinal axes are disposed parallel to one another and which communicate with one another, and the connections discharge into the interior of the base body, in the communicating region of the two substantially circular-cylindrical recesses.

4 Claims, 1 Drawing Sheet

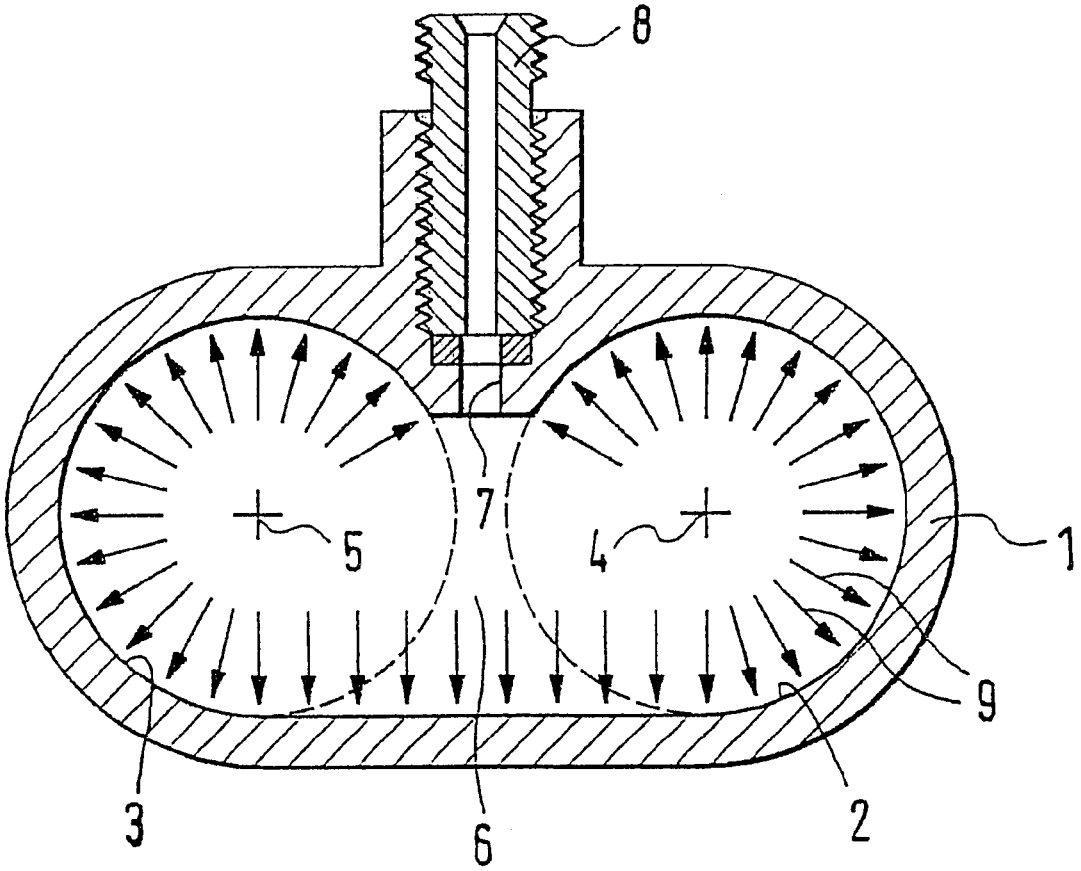
8
7
5
4
1
9
3
6
2

COMMON RAIL

CROSS-REFERENCE TO RELATED APPLICATIONS

This application is a 35 USC 371 application of PCT/DE 00/02840 filed on Aug. 19, 2000.

BACKGROUND OF THE INVENTION

1. Field of the Invention

The invention relates to a common rail for a common rail fuel injection system of an internal combustion engine, having a base body, whose interior communicates with a plurality of connections.

2. Description of the Prior Art

In known common rail injection systems, a high-pressure pump, optionally with the aid of a preferred pump, pumps the fuel to be injected out of a tank into the central high-pressure fuel reservoir, which is also called a common rail. From the rail, fuel lines lead to the various injectors, which are assigned one to each of the cylinders of the engine. The injectors are triggered individually by the engine electronics, as a function of the engine operating parameters, in order to inject fuel into the assigned engine combustion chamber.

A conventional common rail is described in German Patent Disclosure DE 195 48 611, for example. This known common rail withstands pressures of up to about 1100 bar.

OBJECTS AND ADVANTAGES OF THE INVENTION

The primary object of the invention is to increase the high-pressure strength of the known common rail by simple provisions. Furthermore, it should be possible to produce the common rail of the invention economically.

In a common rail for a common rail fuel injection system of an internal combustion engine, having a base body, whose interior communicates with a plurality of connections, this object is attained in that the interior of the rail is formed by at least two substantially circular-cylindrical recesses, whose longitudinal axes are disposed parallel to one another and which communicate with one another, and that the connections discharge into the interior of the base body, in the communicating region of the two substantially circular-cylindrical recesses. In context of the present invention, it has been demonstrated that the region of intersection between the connection openings and the interior of the base body, especially at high internal pressures, is a weak point that can tend to fail because of the development of cracks. Embodying the interior of the base body in accordance with the invention reduces the resultant forces on the critical region of intersection, by means of an integrated hydraulic force compensation. This also assures a long service life, even at high internal pressures. The present invention, using conventional materials and production processes, makes economical manufacture of especially pressure-proof common rails possible.

In one embodiment of the invention, the two substantially circular-cylindrical recesses have the same diameter, and the spacing of the longitudinal axes of the two substantially circular-cylindrical recesses is greater than their diameter. The result is an accumulation of material in the communicating region of the two circular-cylindrical recesses. The material accumulation in the communicating region, viewed in cross section, is acted upon equally by pressure on both sides by means of the fuel stored in the two circular-cylindrical recesses. As a result, it is attained that the common rail of the invention withstands higher internal pressures in operation than conventional common rails.

Another feature of the invention is characterized in that the communicating region between the two substantially circular-cylindrical recesses is embodied in saddle-like form. When rail pressure is applied, this means that in operation, stabilizing hydraulic forces on the region of intersection are operative between the connection openings and the interior of the base body. This increases the high-pressure strength of the common rail of the invention.

BRIEF DESCRIPTION OF THE DRAWINGS

Further advantages, characteristics and details of the invention will become apparent from the ensuing description, taken in conjunction with the single drawing showing a cross section of a common rail embodying the invention.

DESCRIPTION OF THE PREFERRED EMBODIMENT

In the drawing, one embodiment of a common rail embodying the invention is shown in cross section and includes a common rail formed by an elongated base body 1. In the elongated base body 1, two bores 2 and 3 extend longitudinally. The longitudinal axes of the bores 2 and 3 are represented by crosses 4 and 5. The bores 2 and 3 have the same diameter.

The spacing between the longitudinal axes 4 and 5 of the bores 2 and 3 is at least slightly greater than the diameter of the bores. The bores 2 and 3 are connected with one another in the radial direction through a communicating region 6.

A connection bore 7 discharges into the communicating region 6 between the bores 2 and 3. The connection bore creates a communication between the interior of the base body 1 and a high-pressure adaptor piece 8, that serves to connect a high-pressure line (not shown) that leads to an injector of the engine.

In operation of the common rail of the invention, fuel subjected to high pressure is located in the interior of the base body 1. The forces on the base body 1 that result from the internal pressure prevailing in operation are represented in the drawing by a plurality of arrows 9. In the region where the connection bore 7 discharges into the interior of the base body, a saddle-shaped area is formed. When rail pressure is applied, the result is that the forces occurring in operation cancel one another partially out. This reduces the load in the critical region.

The foregoing relates to preferred exemplary embodiments of the invention, it being understood that other variants nd embodiments thereof are possible within the sprit and scope of the invention, the latter being defined by the appended claims.

What is claimed is:

1. A common rail for a common rail fuel injection system of an internal combustion engine, the common rail comprising a base body (1) having an interior communicating with a plurality of connections (7), said interior being formed by at least two substantially circular-cylindrical recesses (2, 3), having longitudinal axes (4, 5) disposed parallel to one another and communicating with one another in a communication region, said connections (7) discharging into said interior of said base body (1) in said communicating region (6) of said two substantially circular-cylindrical recesses (2, 3).

2. The common rail of claim 1, wherein said two substantially circular-cylindrical recesses (2, 3) have the same diameter, and wherein the spacing of the longitudinal axes (4, 5) of said two substantially circular-cylindrical recesses (2, 3) is greater than their diameter.

3. The common rail of claim 2, wherein said communicating region (6) between said two substantially circular-cylindrical recesses (2, 3) is formed in a saddle-like cross sectional configuration.

4. The common rail of claim 1, wherein said communicating region (6) between said two substantially circular-cylindrical recesses (2, 3) is formed in a saddle-like cross sectional configuration.

* * * * *